United States Patent [19]

De Long

[11] 3,989,299

[45] Nov. 2, 1976

[54] STADIUM RISER BACKLESS SEAT, SUPPORT AND ARMREST

[76] Inventor: David C. De Long, 1221 Broad St., Grinnell, Iowa 50112

[22] Filed: July 7, 1975

[21] Appl. No.: 593,767

[52] U.S. Cl. ..... 297/411; 297/232; 297/248; 52/8

[51] Int. Cl.[2] ..... A47C 7/54

[58] Field of Search ..... 297/232, 248, 243, 249, 297/411, 450, 160, 422, 162, 331, 332, 335, 336; 52/8; 108/64, 114

[56] References Cited

UNITED STATES PATENTS

| | | | |
|---|---|---|---|
| 1,351,995 | 9/1920 | Cornish | 297/331 X |
| 3,120,977 | 2/1964 | Albinson | 297/160 |
| 3,241,884 | 3/1966 | Thatcher | 297/243 |
| 3,301,597 | 1/1967 | Bereday | 297/422 |
| 3,482,874 | 12/1969 | Henebry | 297/248 |
| 3,554,142 | 1/1971 | Sorenson et al. | 297/248 X |
| 3,634,925 | 1/1972 | Van Loo | 297/411 |
| 3,702,204 | 11/1972 | Tipton | 297/248 |
| 3,850,476 | 11/1974 | Day | 297/335 |

*Primary Examiner*—James C. Mitchell
*Attorney, Agent, or Firm*—Warren H. Kintzinger

[57] ABSTRACT

A combination seat mounting support and armrest for concrete stadium riser installation where backrests cannot be used or are not desired.

9 Claims, 6 Drawing Figures

FIG. 1
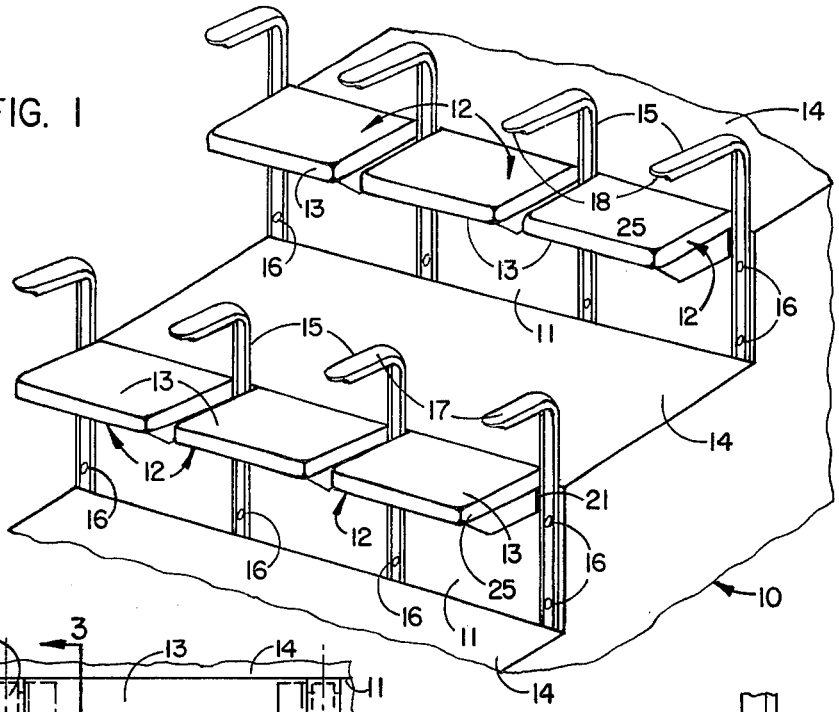
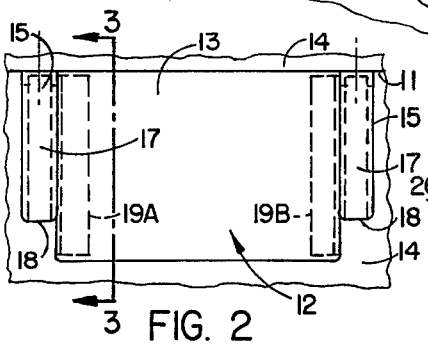
FIG. 2
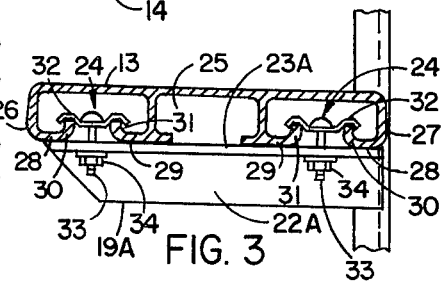
FIG. 3
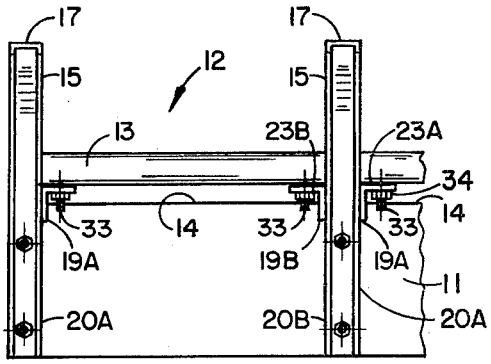
FIG. 4
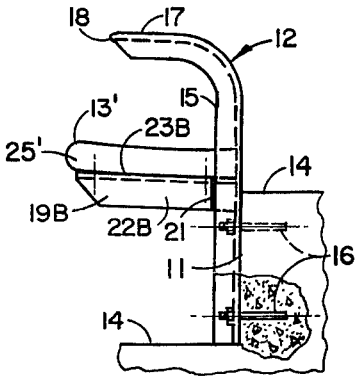
FIG. 5
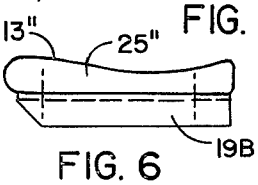
FIG. 6

STADIUM RISER BACKLESS SEAT, SUPPORT AND ARMREST

This invention relates in general to stadium seating, and in particular to a backless seat with combination seat support and arm rest seating mount useful as an upgrading installation on concrete stadium risers.

Replacement of bench seating in existing concrete stadiums is called for as older seating weathers and causes the need for considerable maintenance-repairs and replacement of the old seating. When the need for replacement arises, for many installations upgrading of the seating is also desired. A major problem here, however, is that the riser depth of the old installation is often less than thirty inches, and the building codes of many jurisdictions state specifically that seat backrests cannot be used where riser depths are less than thirty inches. Another consideration is that of expense, yet various people, such as school administrators, want to do something with their existing stadiums, for booster clubs and/or alumni, such as would be provided by improved stadium reserved seat sections.

It is therefore a principal object of this invention to provide improved individual seats in concrete stadiums.

Another object is to provide such individual seating as a replacement for stadium bench seating.

A further object is to provide individual seating that meets building codes for concrete riser structured stadiums.

Still another object is to provide individual, stationary, fixed stadium seats separated by arm rests mounted on concrete risers.

Features of this invention useful in accomplishing the above objects include, in a concrete stadium riser backless seat, combination support and arm rest, U-shaped in section channel members vertically mounted to the vertical face of stadium risers, such as in a concrete riser equipped stadium, by bolt nuts on studs. The U-shaped channel members are formed over at their upper ends to form forwardly extended arm rests at each side of each individual seat, and between adjoining seats. Structural angle members bonded to the U-shaped channel members (as by welding) project forward to support seats bolted on the tops thereof at the bottom of each seat side.

A specific embodiment representing what is presently regarded as the best mode of carrying out the invention is illustrated in the accompanying drawing.

In the drawing:

FIG. 1 represents a partial perspective of a stadium section equipped with backless seats of the invention mounted on concrete stadium risers;

FIG. 2, a top plan view of an individual backless seat mounted on a stadium riser;

FIG. 3, an enlarged partial side elevation section view taken along line 3—3 of FIG. 2;

FIG. 4, a partial front elevation view of the backless stadium seating;

FIG. 5, a side elevation view of a backless stadium seat; and,

FIG. 6, a partial side elevation view of a backless seat with a contoured seat installed instead of the semi-contoured seat used with the stadium seat of FIG. 5.

Referring to the drawing:

The stadium section 10 of FIG. 1 is shown to be a multiple riser 11 structured concrete stadium such as may have previously been equipped with bench seating, but now is equipped with individual stationary backless seats 12. The seat bottoms 13 are individually mounted to project forwardly above and out from the mounting riser 11, over respective stadium riser step surfaces 14. The individual stationary backless seats 12 are fixed in place with U-shaped channel members 15 vertically mounted to the vertical face of stadium risers 11 by a plurality of nut and stud assemblies 16 anchor-embedded in concrete of the stadium seating risers 11.

Referring also to FIGS. 2, 3, 4, and 5, the U-shaped channel members 15 are formed over in almost a right angle bend to extend forward at the channel tops as armrests 17 at the seat sides, and as a common armrest between adjacent seats. The U-shape of the channel members 15 faces forward, away from the stadium riser 11 vertical step faces, and downward in the armrest portions. This advantageously protects the otherwise exposed portions of the channel member 15 mounting nut and stud assemblies 16. The channel sides of channel members 15, at the forward end 18 of the armrests 17 are cut back at an angle and corners are rounded, along with end 18, to minimize catching and cutting of clothing and accidental injury to stadium users. Seat bottom 13 mounting, opposite angled structural angle members 19A and 19B, are bonded to channel sides 20A and 20B, respectively, of channel members 15, as by weldments 21. Structural angle members 19A and 19B are mounted at a small back-to-front upward slope to mount seat bottoms 13, 13' of FIG. 5, or 13'' of FIG. 6 for optimized user comfort. The sides 22A and 22B of angle members 19A and 19B are cut back at an angle and edges are rounded just like with the armrests 17 of channel members 15. The flange tops 23A and 23B of each cooperating pair of angle members 19A and 19B mounts a seat bottom 13, 13', or 13'' with bolt-clip assemblies 24. Individual seat bottoms 13 are box-like structures having end closure caps 25, and are equipped with bottom open underside channels 26 and 27 extended transversely from side to side across each seat bottom 13. Each of the underside channels 26 and 27 has bottom outer and inner lips or webs 28 and 29 with upturned edge extensions 30 and 31. Clips 32, shaped to fit over the tops of the edge extensions 30 and 31 and span the space therebetween, are used as part of bolt-clip assemblies 24 used for securing the seat bottoms 13 in place on flange tops 23A and 23B. Bolts 33 of bolt-clip assemblies 24 extend to nuts 34 through the clips 32 and respective flange tops 23A and 23B.

It is of interest to note that angle members 19A and 19B mount the individual seat bottoms 13, 13' or 13'' high enough above the stadium riser step surface 14, immediately therebehind to present an opening for water flow down from one riser step to the next lower riser step. This minimizes the retention of rain water in puddles behind seats in outside stadiums and/or facilitates the hosing wash-down of stadiums. A semi-contoured seat 13' such as shown in FIG. 5, having substantially the same hold down mounting structure as with the more box-like seat of FIGS. 1 through 4, may be used. In like manner, the more fully contoured seat 13'' of FIG. 6 could be used. Aluminum U-shaped channel members 15 with structural angle aluminum members 19A and 19B welded thereto are being used to mount fixed-position aluminum seat bottoms 13 or 13' or 13'' in providing long life, substantially maintenance-free, upgraded stadium individual backless seating.

Whereas this invention is here illustrated and described with respect to several embodiments hereof, it should be realized that various changes may be made without departing from the essential contributions to the art made by the teachings hereof.

I claim:

1. In step riser mounted seating: individual seat means including, structural members adapted to be mounted to the upright face of a step riser at each side of a seat; individual seat bottom means adapted for being mounted between and by two of said structural members; said structural members being extended transversely above and below said individual seat bottom means mounted thereby; with the upper longitudinally extending portions of said structural members formed over by substantially ninety degrees so as to coextend with, and be substantially parallel to, said seat bottom means, to provide armrest sections above and to each side of said individual seat bottom means; each of said structural members being a continuous expanse of U-shaped channels with the exterior surface of the channel web adapted to be juxtaposed with, and mounted to, the upright vertical face of a step riser; and with such channel web exterior surface presenting upward facing armrest surfacing.

2. The seat structure of claim 1, wherein said channel members are each mountable to the upright vertical facing of a concrete stadium by a plurality of stud and nut assemblies, with the studs extended through throughholes in said channel web and anchored in concrete of the stadium step riser structure.

3. The seat structure of claim 2, wherein the mounting of said individual seat bottom means includes structural angle members attached to said channel members to extend out from the channel members and away from the step riser mounting the respective channel members; and fastening means for fixedly mounting individual seat bottom means in place on respective pairs of said structural angle members.

4. The seat structure of claim 3, wherein individual seat bottom means are mounted higher than the upper surface of the stadium step riser mounting respective seats.

5. The seat structure of claim 3, wherein individual seat bottom means are bolted down at four corners to respective pairs of said structural angle means.

6. The seat structure of claim 3, wherein said individual seat bottom means include underside bottom open underside channel means having inner lip means; and a plurality of bolt-clip assembly means engaging said inner lip means of the channel means and extended through respective pairs of said structural angle means to secure the individual seat bottom means in place.

7. The seat structure of claim 6, wherein said individual seat bottom means underside bottom open underside channel means are at least two channels extended transversely from side to side across each seat bottom; and with end cap means closing each side end of individual seat bottoms.

8. The seat structure of claim 1, with individual seat bottoms box like structures.

9. The seat structure of claim 7, with individual seat bottoms having seat contoured upper surfaces.

* * * * *